US011769944B2

(12) United States Patent
Towfiq et al.

(10) Patent No.: US 11,769,944 B2
(45) **Date of Patent: *Sep. 26, 2023**

(54) RECONFIGURABLE ANTENNA ARRAY OF INDIVIDUAL RECONFIGURABLE ANTENNAS

(71) Applicants: i5 Technologies, Inc., North Logan, UT (US); Utah State University, Logan, UT (US)

(72) Inventors: Asaduzzaman Towfiq, North Logan, UT (US); Bedri A. Cetiner, North Logan, UT (US)

(73) Assignees: i5 Technologies, Inc., North Logan, UT (US); Utah State University, Logan, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/566,145

(22) Filed: Dec. 30, 2021

(65) Prior Publication Data

US 2022/0123465 A1 Apr. 21, 2022

Related U.S. Application Data

(63) Continuation of application No. 16/686,474, filed on Nov. 18, 2019, now Pat. No. 11,217,888.

(51) Int. Cl.
*H01Q 3/26* (2006.01)
*H01Q 21/06* (2006.01)
(Continued)

(52) U.S. Cl.
CPC ..... *H01Q 3/2617* (2013.01); *H01Q 9/0442* (2013.01); *H01Q 19/005* (2013.01); *H01Q 21/065* (2013.01)

(58) Field of Classification Search
CPC ..... H01Q 3/01; H01Q 21/065; H01Q 19/005; H01Q 3/40; H01Q 3/24; H01Q 25/00;
(Continued)

(56) References Cited

U.S. PATENT DOCUMENTS 8,373,608 B2 2/2013 Drexler
9,379,449 B2 6/2016 Cetiner et al.
(Continued)

OTHER PUBLICATIONS

Li et al., "A new class of antenna array with reconfigurable element factor," IEEE Transactions on Antennas and Propagation, 2013, 61(4):1947-1955.

*Primary Examiner* — Vibol Tan
(74) *Attorney, Agent, or Firm* — Fish & Richardson P.C.

(57) ABSTRACT

Among other things, a reconfigurable antenna array (RAA) includes individual pattern reconfigurable antennas (PRA). Each of the PRAs has (a) an antenna, (b) components controllable to generate and effect any of two or more modes of the PRA, the modes having respectively different steered radiation patterns, and (c) inputs to receive drive signals for the antenna and control signals for the controllable components. Control circuitry has outputs coupled to the inputs of the PRAs to drive the antennas of the PRAs to form an array beam having an array peak in a particular direction and at the same time to deliver control signals for the controllable components to effect a selected mode of each of the PRAs for which the steered radiation pattern has a peak in the particular direction of the array beam and has one or more nulls in the directions of one or more of the side-lobes of the array beam.

18 Claims, 20 Drawing Sheets

(51) Int. Cl.
*H01Q 9/04* (2006.01)
*H01Q 19/00* (2006.01)

(58) Field of Classification Search
CPC ..... H01Q 3/26; H01Q 13/10; H01Q 19/10; H01Q 3/247; H01Q 5/385; H01Q 9/0428; H01Q 1/523; H01Q 21/00; H01Q 3/2611; H01Q 3/2617; H01Q 3/2658; H01Q 3/2682; H01Q 3/28; H01Q 3/30; H01Q 3/46; H01Q 5/328; H01Q 5/00
See application file for complete search history.

(56) References Cited

U.S. PATENT DOCUMENTS 9,466,885 B1 10/2016 Farmahini
9,673,960 B2 6/2017 Eltawil
9,748,645 B2 * 8/2017 Mohamadi ..... H01Q 21/0031
9,831,551 B2 11/2017 Piazza
10,224,979 B1 * 3/2019 Hunter ..... H01Q 15/02
10,277,382 B2 4/2019 Eltawil
10,490,903 B2 11/2019 Foo
10,798,715 B2 * 10/2020 Sturkovich ..... H04B 7/0617
11,088,447 B2 * 8/2021 Polehn ..... H01Q 1/523
11,158,939 B2 * 10/2021 Yilmaz ..... H01Q 1/24
11,217,888 B2 1/2022 Towfiq et al.
2009/0146895 A1 6/2009 Drexler
2013/0176177 A1 7/2013 Cetiner et al.
2015/0333413 A1 11/2015 Piazza
2015/0341157 A1 11/2015 Eltawil
2018/0131089 A1 5/2018 Yilmaz
2021/0151877 A1 5/2021 Towfiq et al.

* cited by examiner (a) Max Gain 12.7 dB ($\theta$ = 0)
(b) Max Gain 12.3 dB ($\theta$ = 15)
(c) Max Gain 11.7 dB ($\theta$ = 30)

(a) Max Gain 18.5 dB ( $\theta$ = 0)
(b) Max Gain 18.7 dB ( $\theta$ = 15)
(c) Max Gain 19.5 dB ( $\theta$ = 30)

| Steering Angle (degree) | Max Gain (dB) | |
|---|---|---|
| | Legacy PA | MRAA |
| 0 | 12.7 (72) | 18.5 (66) |
| -30 | 11.7 (70) | 19.5 (64) |
| 30 | 11.7 (74) | 19.5 (68) |

RECONFIGURABLE ANTENNA ARRAY OF INDIVIDUAL RECONFIGURABLE ANTENNAS

CROSS-REFERENCE TO RELATED APPLICATIONS

This application is a continuation application of, and claims benefit under 35 USC 120 to, U.S. application Ser. No. 16/686,474, filed on Nov. 18, 2019. The entire disclosure of this application is incorporated by reference herein.

This invention was made with Government support under (NSF award #1758543) awarded by the National Science Foundation. The Government has certain rights in this invention.

BACKGROUND

This description relates to a reconfigurable antenna array of individual reconfigurable antennas. mm-wave spectrum offers wide-band RF channels that can support the highest possible data rates available in 5G networks based on the 3GPP New Radio (NR) standard. Due to the high path loss in mm-wave bands, antennas with high gain are necessary for such 5G networks. Large phased arrays of antennas are traditionally used to obtain high gain. Yet higher cost and power consumption of legacy phased arrays make this approach prohibitive. Sparse arrays (i.e., inter-element spacing >one-$\lambda_{air}$, that is, one wavelength in air at the frequency of interest), where for a given array size a smaller number of antenna elements are provided, have been used to reduce the complexity and cost of legacy phased arrays. However, due to large inter-element spacing, the side lobe levels for sparse arrays become excessively large. While amplitude tapering can be used to reduce the high side-lobe levels of sparse arrays, this comes at the cost of reduced gain.

Traditionally, quarter wavelength thick superstrates placed above driven antennas have been shown to increase gain. Increase in gain is proportional to the dielectric constant of the superstrate and inversely proportional to bandwidth.

SUMMARY

In general, in an aspect, a reconfigurable antenna array (RAA) includes individual pattern reconfigurable antennas (PRA). Each of the PRAs has (a) an antenna, (b) components controllable to generate and effect any of two or more modes of the PRA, the modes having respectively different steered radiation patterns, and (c) inputs to receive drive signals for the antenna and control signals for the controllable components. Control circuitry (e.g., a beam former circuit and a beam control unit) has outputs coupled to the inputs of the PRAs to drive the antennas of the PRAs to form an array beam having an array peak in a particular direction and at the same time to deliver control signals for the controllable components to effect a selected mode of each of the PRAs for which the steered radiation pattern has a peak in the particular direction of the array beam and has one or more nulls in the directions of one or more of the side-lobes of the array beam.

Implementations may include one, or a combination of two or more, of the following features. The different steered radiation patterns include different polarizations. The different steered radiation patterns include different frequencies. The RAA includes a reconfigurable sparse antenna array (RSAA). The controllable components include switching devices. The switching devices include PIN diodes. The individual pattern reconfigurable antennas are sparsely spaced. There is a superstrate spaced apart from the individual pattern reconfigurable antennas. The controllable components include a reconfigurable parasitic layer. The control circuitry includes a beam former circuit. The control circuitry includes a processor executing an algorithm.

In general, in an aspect, pattern reconfigurable antennas (PRAs) that are part of a reconfigurable antenna array (RAA) are driven to form an array beam having an array peak in a particular direction. At the same time components of each of the PRAs are controlled to effect a selected mode of each of the PRAs for which the steered radiation pattern has a peak in the particular direction of the array beam and has one or more nulls in the directions of one or more of the side-lobes of the array beam.

Implementations may include one, or a combination of two or more, of the following features. The different steered radiation patterns include different polarizations. The different steered radiation patterns include different frequencies. The RAA includes a reconfigurable sparse antenna array (RSAA). The controlling of the components includes switching the states of switching devices. The controlling of the components includes switching the states of PIN diodes.

These and other aspects, features, implementations, and advantages (a) can be expressed as methods, apparatus, systems, components, program products, means or steps for performing functions, and in other ways, and (b) will become apparent from the following description and from the claims.

DESCRIPTION

FIGS. 3, 4, 5, and 14 show simulation radiation patterns.

Figure 6:
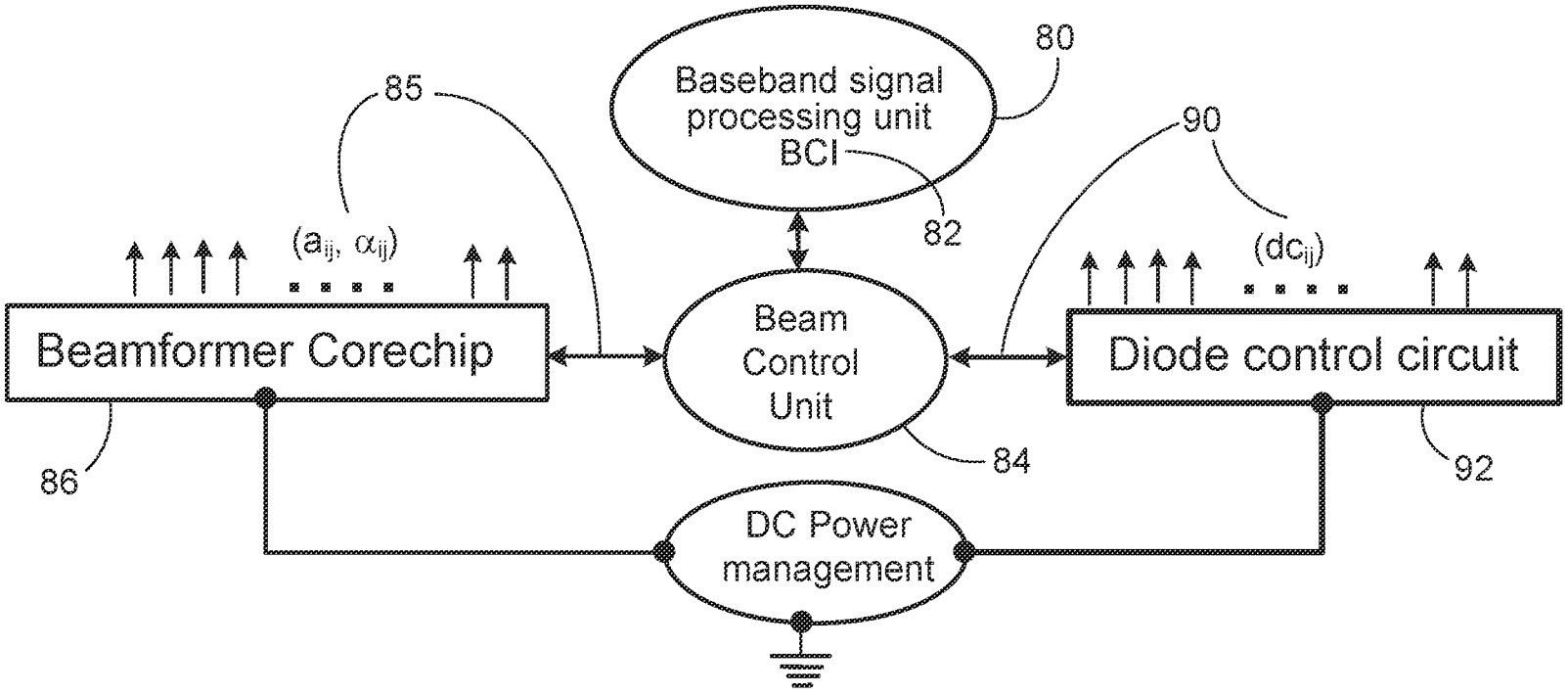
Figure 7:
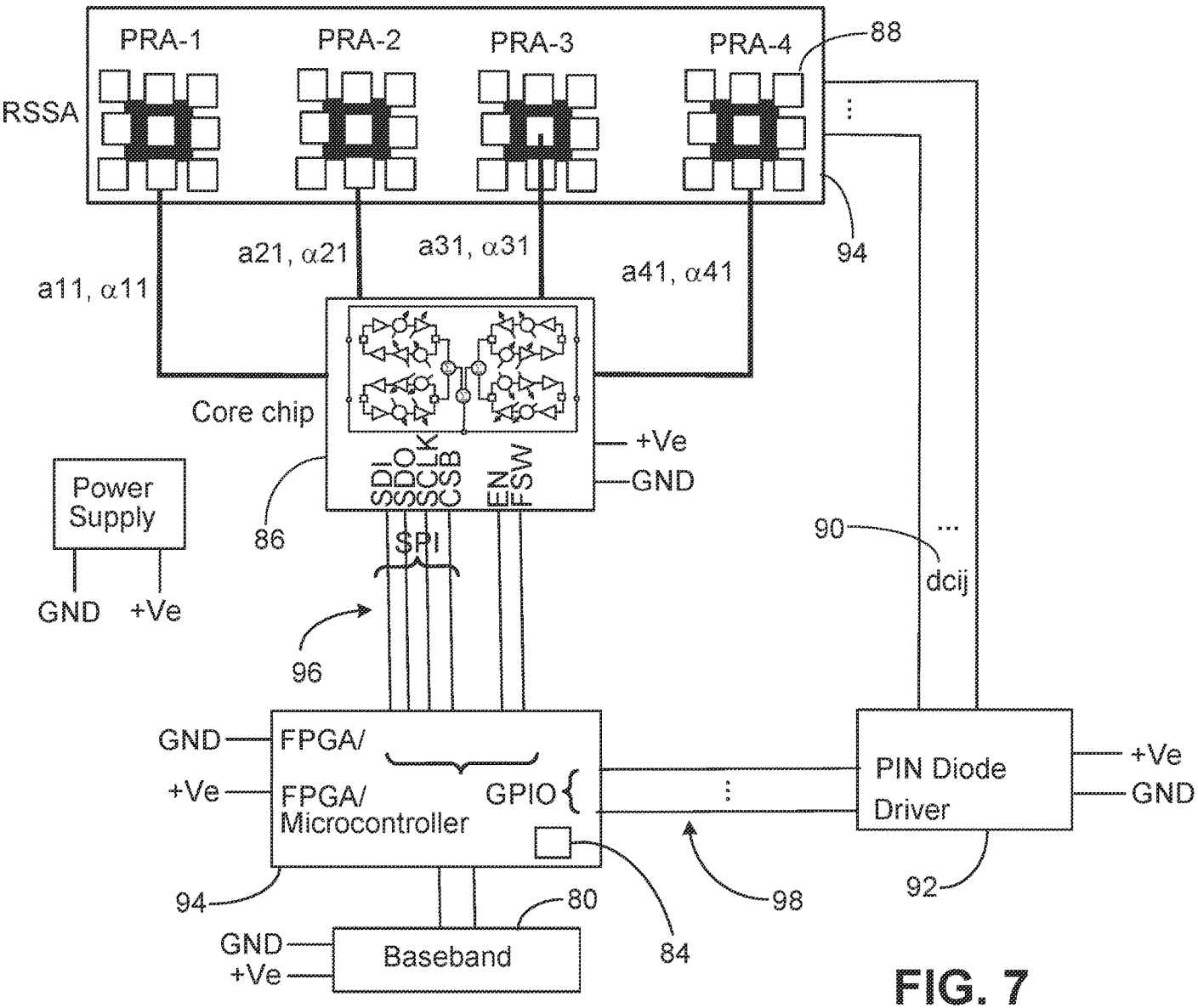

FIGS. 6 and 7 are block diagrams.

Figure 8:
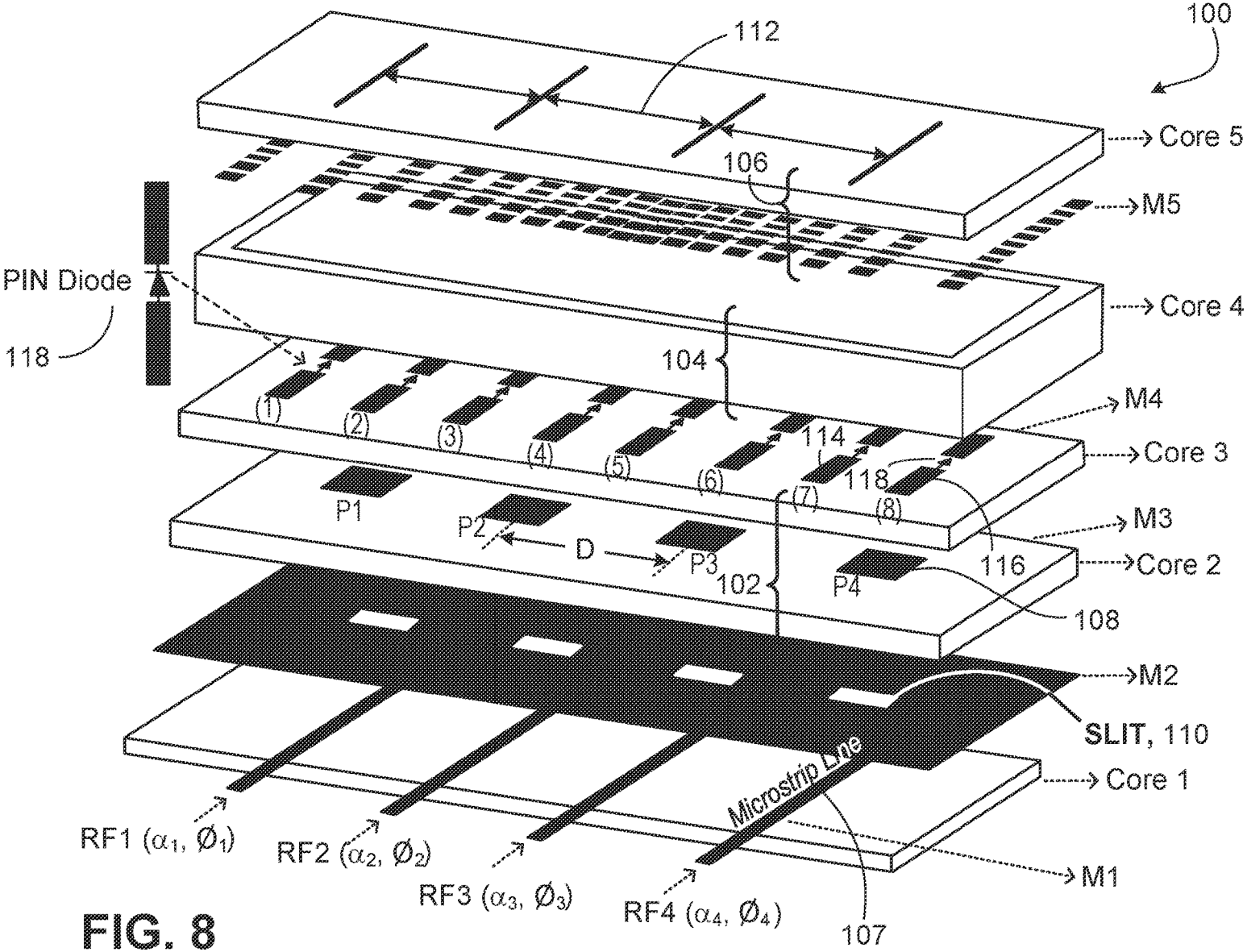

FIG. 8 is a three-dimensional exploded view of a sparse antenna array architecture.

Figure 9:
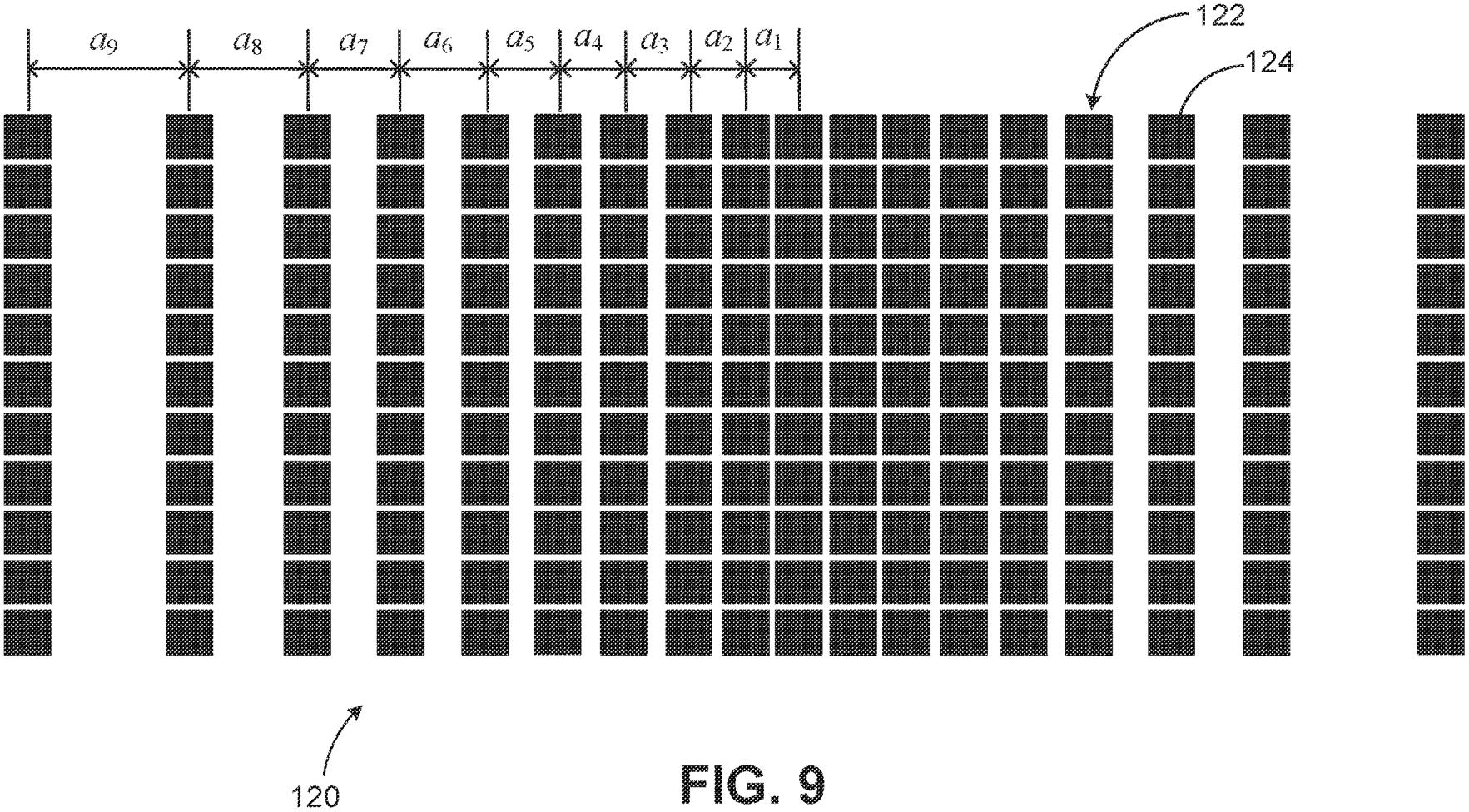

FIG. 9 is a top view of a partially reflective surface.

Figure 10:
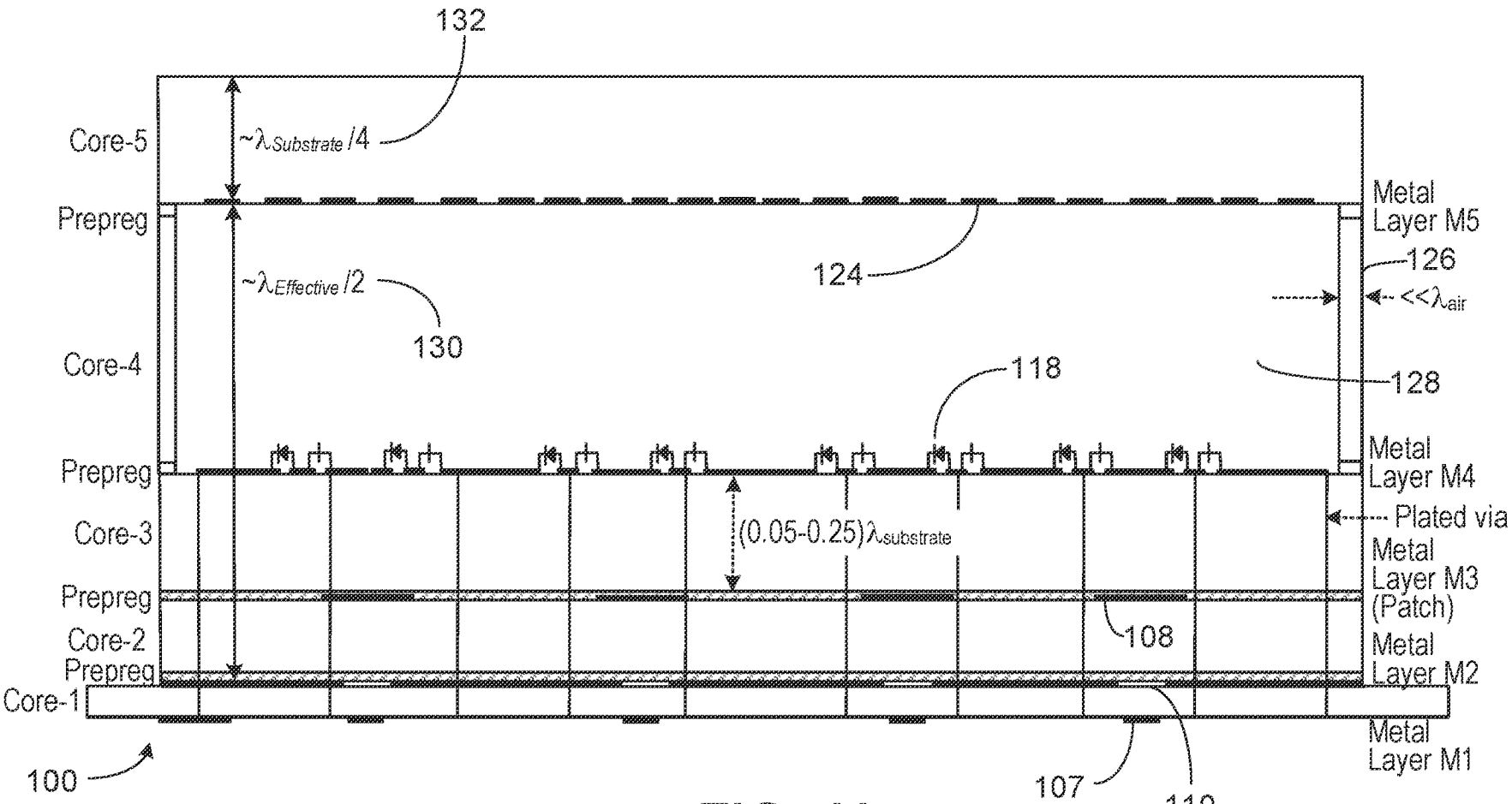

FIG. 10 is a cross-sectional view of a sparse antenna array architecture.

Figure 11:
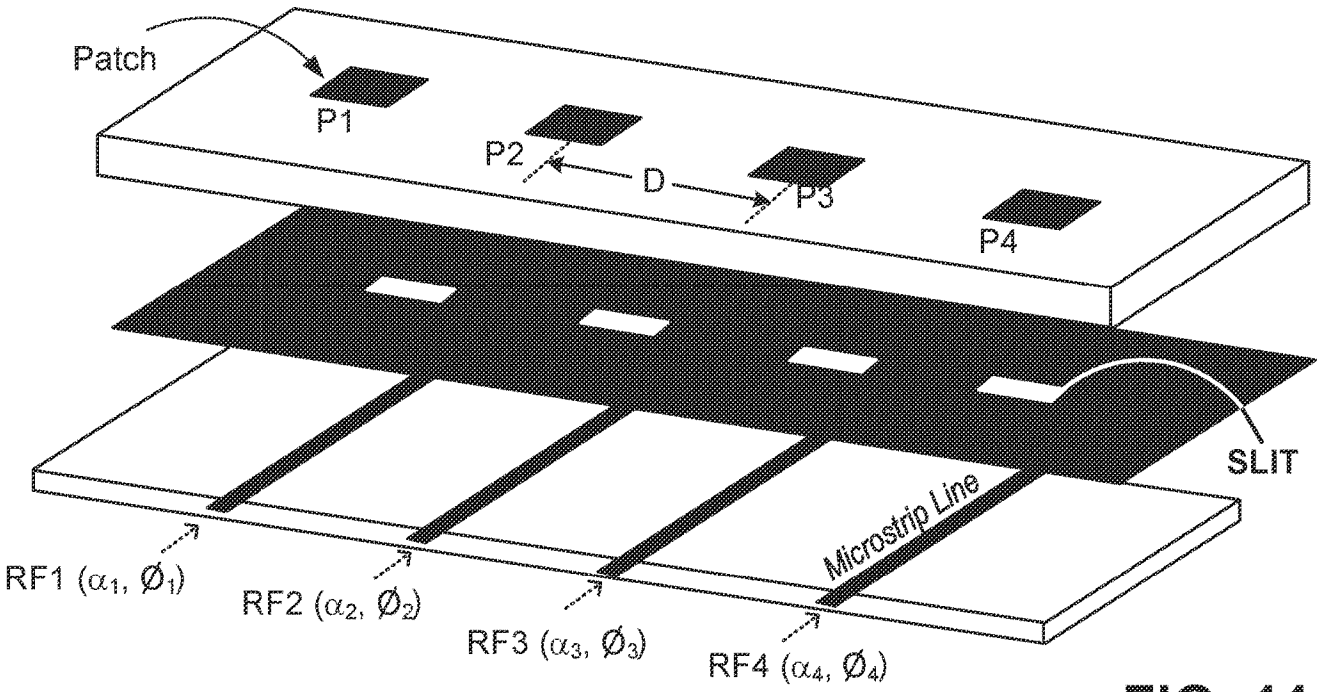

FIG. 11 is a three-dimensional exploded view of a legacy sparse antenna array architecture.

Figure 12:
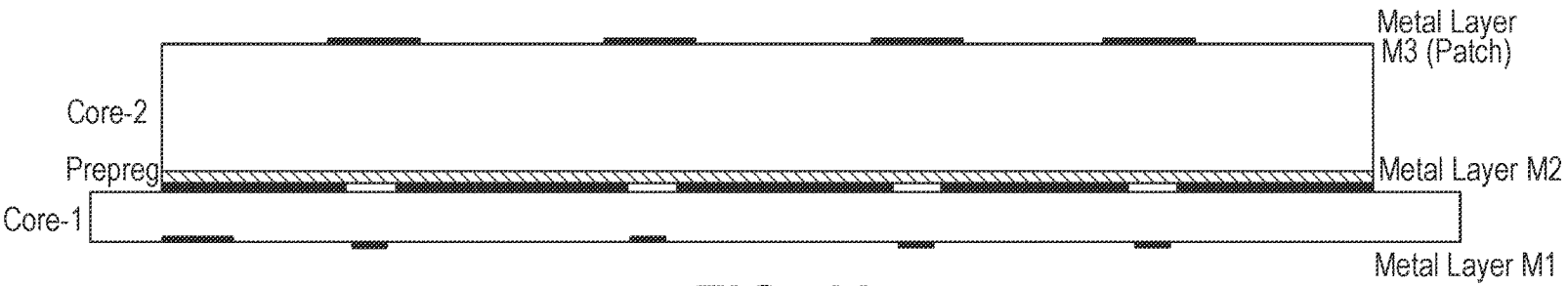

FIG. 12 is a cross-sectional view of a legacy sparse antenna array architecture.

Figure 13:
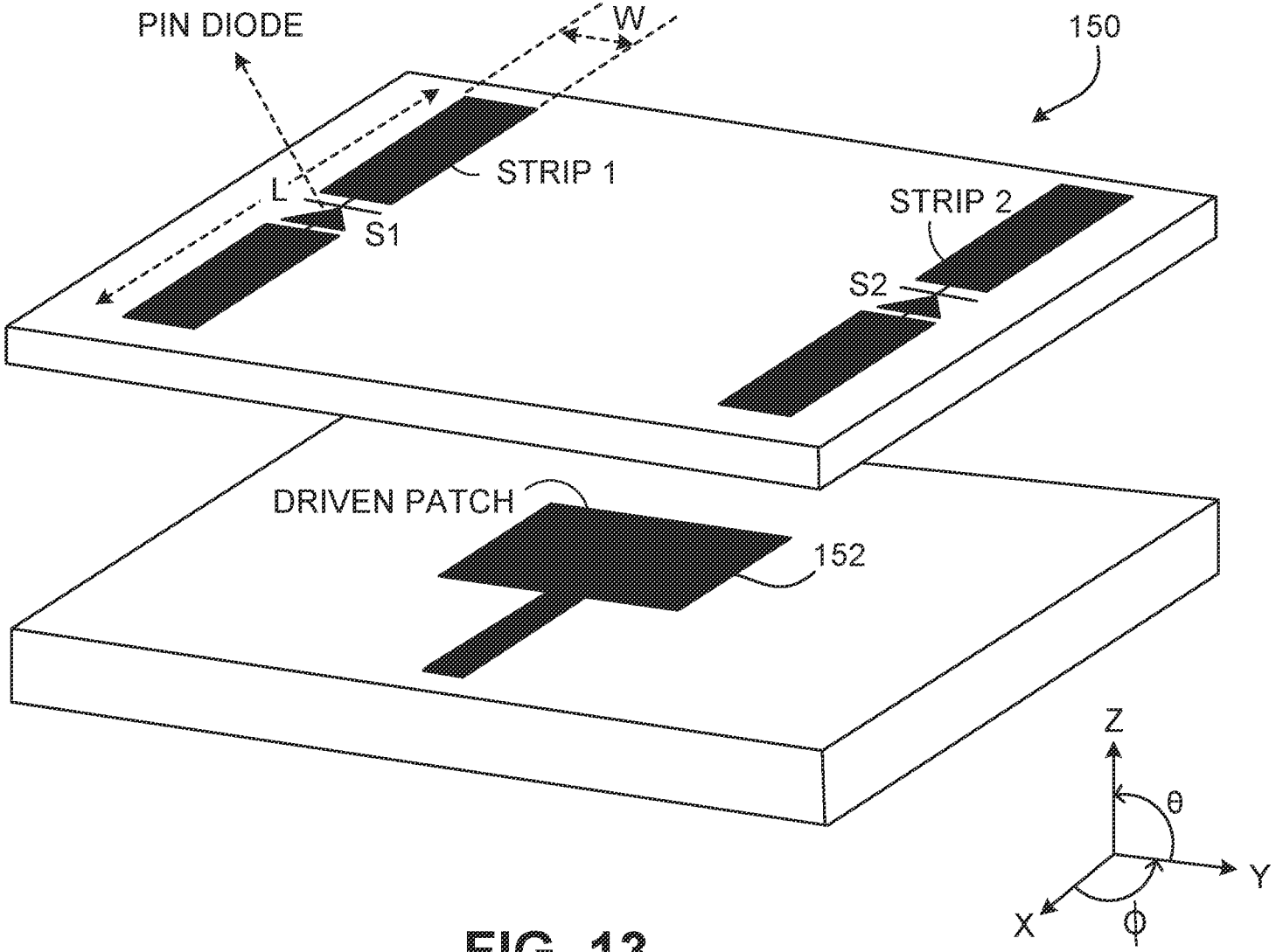

FIG. 13 shows a generic individual pattern reconfigurable antenna element.

FIGS. 15 through 21 are three-dimensional views of pattern reconfigurable antenna elements.

Here we describe technology using a sparse antenna array configuration where the individual antenna elements are pattern reconfigurable antennas (PRAs). Superstrates having a relatively low dielectric constant placed above (that is, spaced apart from) the PRAs result in increased gain for each individual PRA. The radiation pattern of each individual PRA is dynamically reconfigured—by using a reconfigurable parasitic layer—in order to align its radiation pattern maximum with the array factor maximum of the sparse array and to align its nulls with the side lobes of the array factor, respectively. This reduces the sparse array side lobe levels and increases the antenna array gain thereby alleviating drawbacks of legacy sparse arrays. In addition, a partially reflective surface (PRS) is placed underneath the superstrate to further reduce the side-lobe levels.

Figure 1:
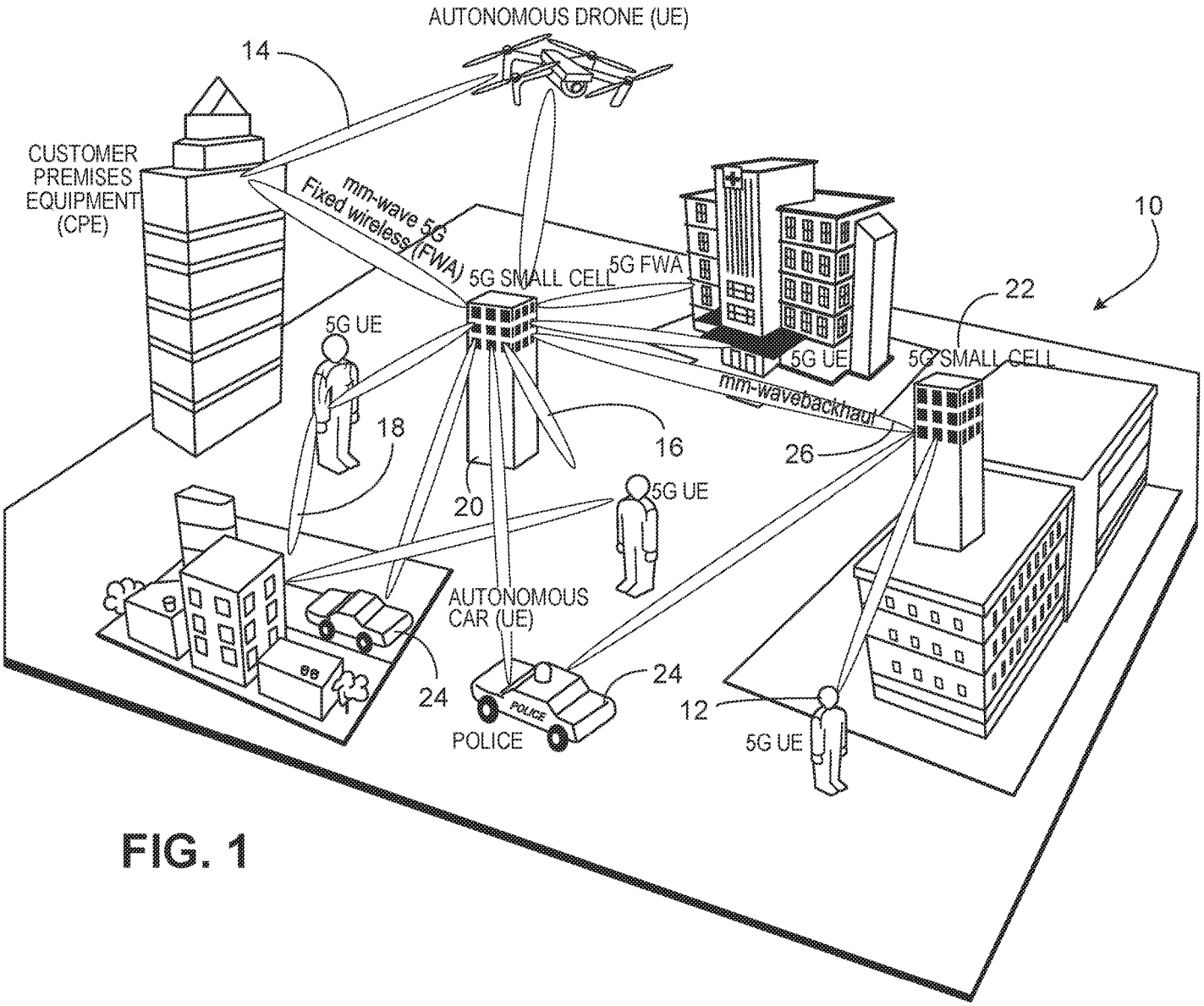
FIG. 1 shows a 5G system.

In mm-wave 5G systems, base stations will dynamically steer the phased array beams toward intended users to provide best data rate and reduce interference for other users. FIG. 1 shows beam-steering in a typical mm-wave 5G system 10. In such a system, devices of static users and mobile users 12 are served by steerable radiation beams 14, 16, 18 for sending and receiving signals to and from antennas, for example, antennas on towers 20, in small cells 22, and on automobiles 24. The antennas in turn are served by a backhaul network 26.

Figure 2:
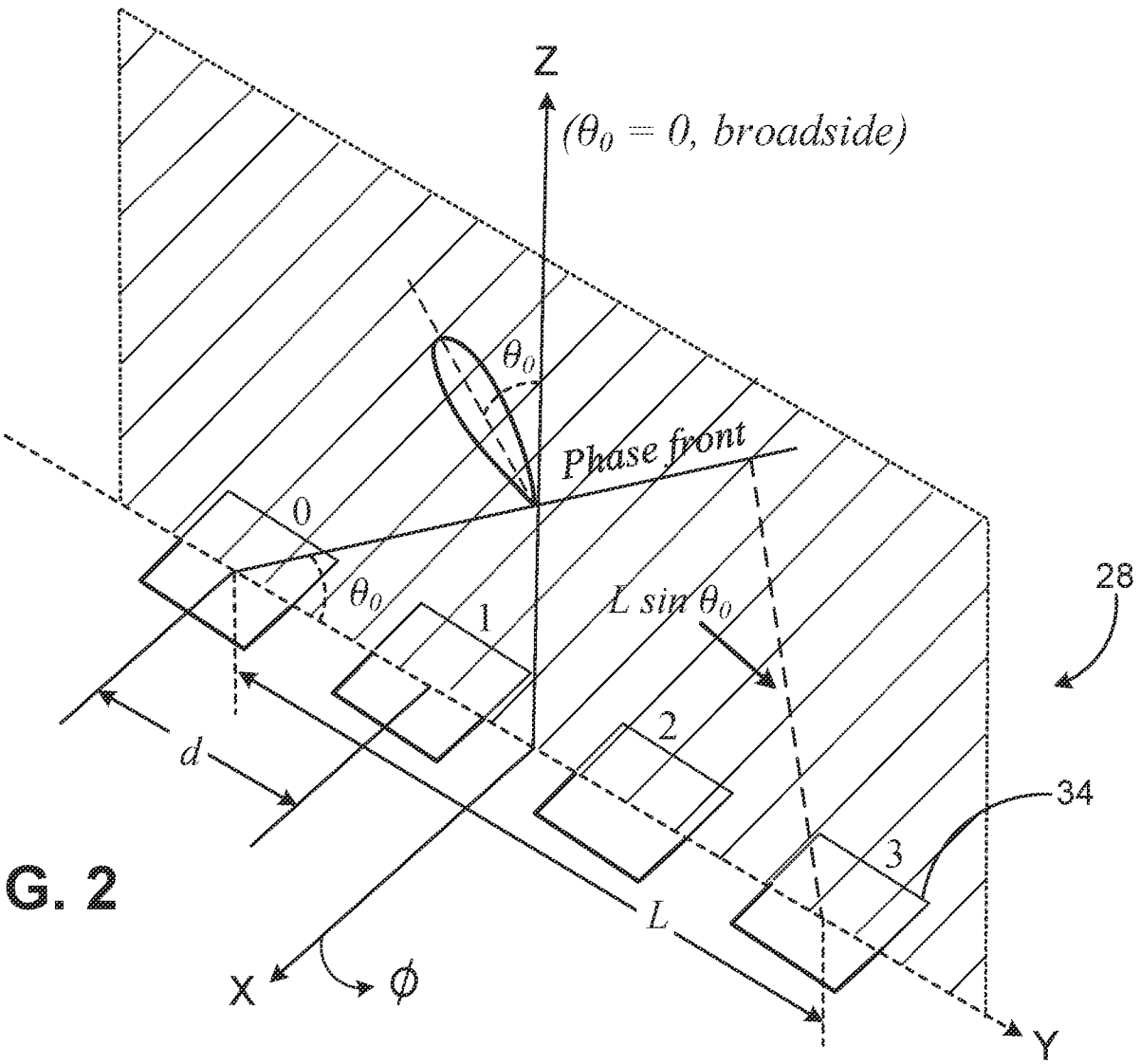
FIG. 2 shows a phased array antenna.

Let us consider a 4×1 linear phased array antenna (PAA) 28 as shown in FIG. 2 in which each of the four individual antenna elements is a patch antenna 34. The total far-field radiation pattern F (θ, ϕ) of a phased array of individual radiators is found by the principle of pattern multiplication and is given below, $$F(\theta,\phi)=E_a(\theta,\phi)\times F_a(\theta,\phi) \tag{1}$$

In (1), $E_a(\theta, \phi)$ is the normalized pattern of each of the individual radiator elements, which is also called the element factor. $F_a(\theta, \phi)$ is the normalized array factor, which for uniform amplitude excitations in the y-z plane is given as follows, $$F_a(\theta)=\frac{\sin\left[\frac{N\pi d}{\lambda_0}*(\sin\theta-\sin\theta_0)\right]}{N\sin\left[\frac{\pi d}{\lambda_0}*(\sin\theta-\sin\theta_0)\right]} \tag{2}$$

In (2), N=4 is the total number of array elements (the example of FIG. 2), and $\theta=\theta_0$ is the beam steering direction in the y-z plane for which the array factor is maximum.

In legacy PAAs, the element factor in (1) remains fixed by initial design, which means that the radiation properties of the individual radiators cannot be changed during operation of the PAA, and thus the element factor cannot play a role in the beam-steering function. The only degree of freedom for beam steering is the array factor, which therefore determines the total radiation pattern. This limitation of legacy phased antenna arrays results in scan loss. This is due to the broadening of the beam width of the array factor when the beam is steered away from the broadside direction. The result is a reduction in the array gain, which becomes significant as the beam is steered farther away from the broadside.

The technology that we describe here includes a reconfigurable sparse antenna array (RSAA) which utilizes individual pattern reconfigurable antenna (PRA) elements along with superstrates to obtain high-gain beam scanning with low side lobe levels.

In some implementations of the technology, an individual PRA element's driven antenna may be a patch antenna, among other possible kinds of antennas. In the near-field region of each patch antenna are placed one or more solid or liquid metallic layers having embedded switching elements (e.g., PIN diodes, varactor, MEMS, CNT (carbon nano tubes), microfluidics, etc., and combinations of them). These metallic layers, which are called reconfigurable parasitic layers, enable the radiation pattern of each individual PRA element to be changed by turning on and off a specific group of the switching elements for that antenna, as explained later.

In some examples of the technology, the inter-element spacing between adjacent PRA elements is made larger than one-$\lambda_{air}$ (wavelength in air), which not only results in a larger antenna aperture and thus larger antenna gain but also enables better control of the mutual coupling between the PRA elements and the reconfigurable parasitic layers, which in turn results in being able to achieve finer reconfiguration of each PRA element's radiation pattern. One or more superstrates with quarter-wave thickness placed above the driven antenna elements are used to further enhance the gain of the antenna array.

A beamformer circuit (e.g., a beamformer integrated circuit, or chip) is used to feed the individual antenna elements of the antenna array by exciting the array coefficients, i.e., phases and amplitudes, of the phased array to dynamically control and adjust the array factor. In conjunction with controlling and adjusting the array coefficients of the beamformer circuit to control the array factor, by judiciously driving a control circuit for the switch elements, a peak of each of the PRA element's radiation pattern is steered toward a peak of the radiation pattern of the array factor to increase the antenna array gain, and the nulls of each of the PRA elements is steered toward the side lobes of the array factor to reduce the antenna array side lobes. Therefore, the reconfigurable sparse antenna array (RSAA) of the technology that we describe here has individual radiators (antenna elements) for each of which maximum radiation beam directions can be changed. In other words, the element factor is not fixed and can be dynamically varied. This additional degree of freedom in conjunction with higher individual element gain translates into higher array gain and lower side lobes.

For the RSAA that we describe here, (1) therefore can be rewritten as follows, $$F(\theta,\phi)=E_{aM}(\theta,\phi)\times F_a(\theta,\phi) \tag{3}$$

In (3), subscript M represents a reconfigurable antenna mode where M=1, 2, . . . m. Each of the modes corresponds to particular reconfigurations of one or more of the individual antenna elements achieved, for example, by control of the switch elements of the respective individual antenna elements.

Figure 3:
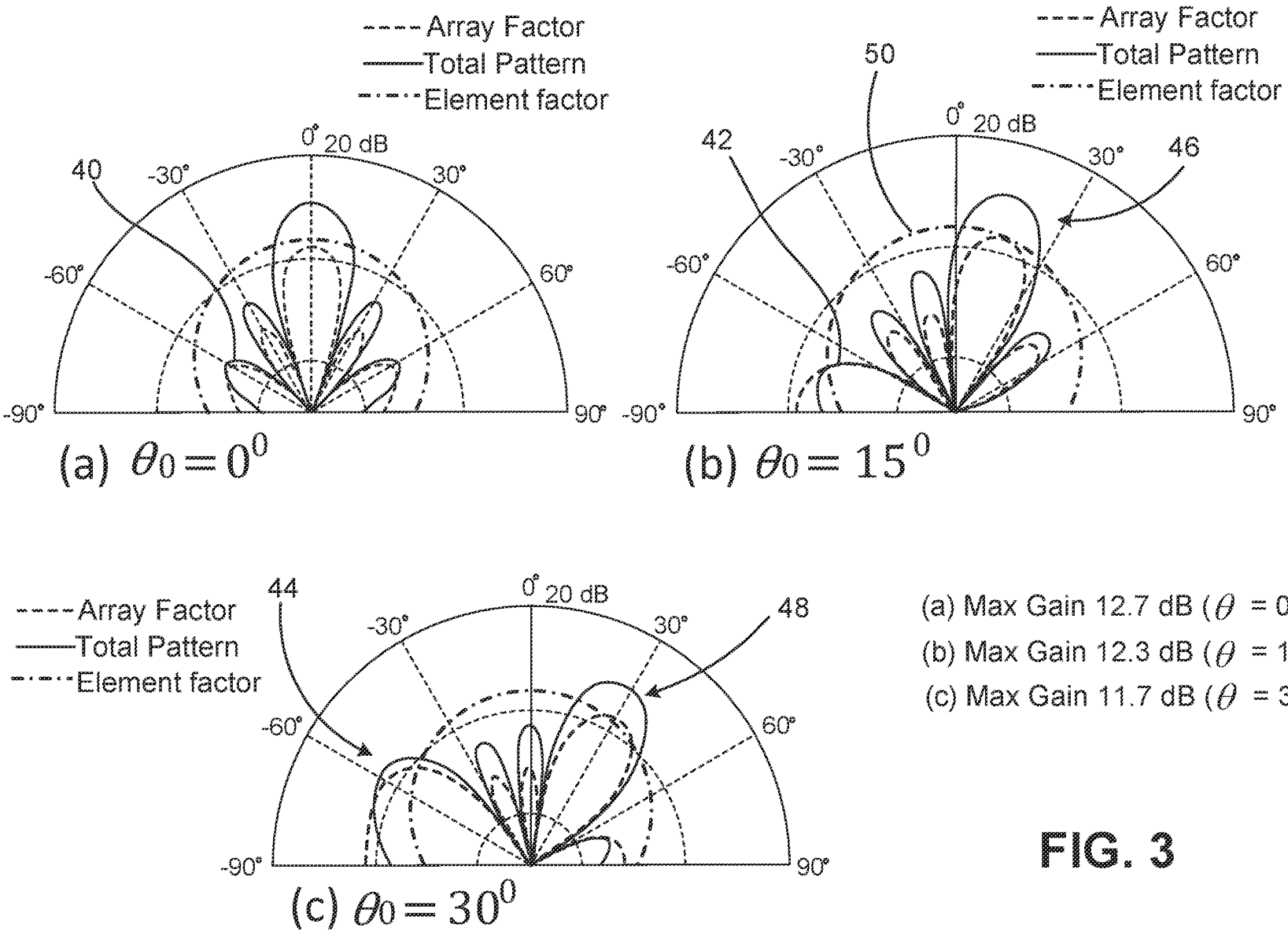
Figure 4:
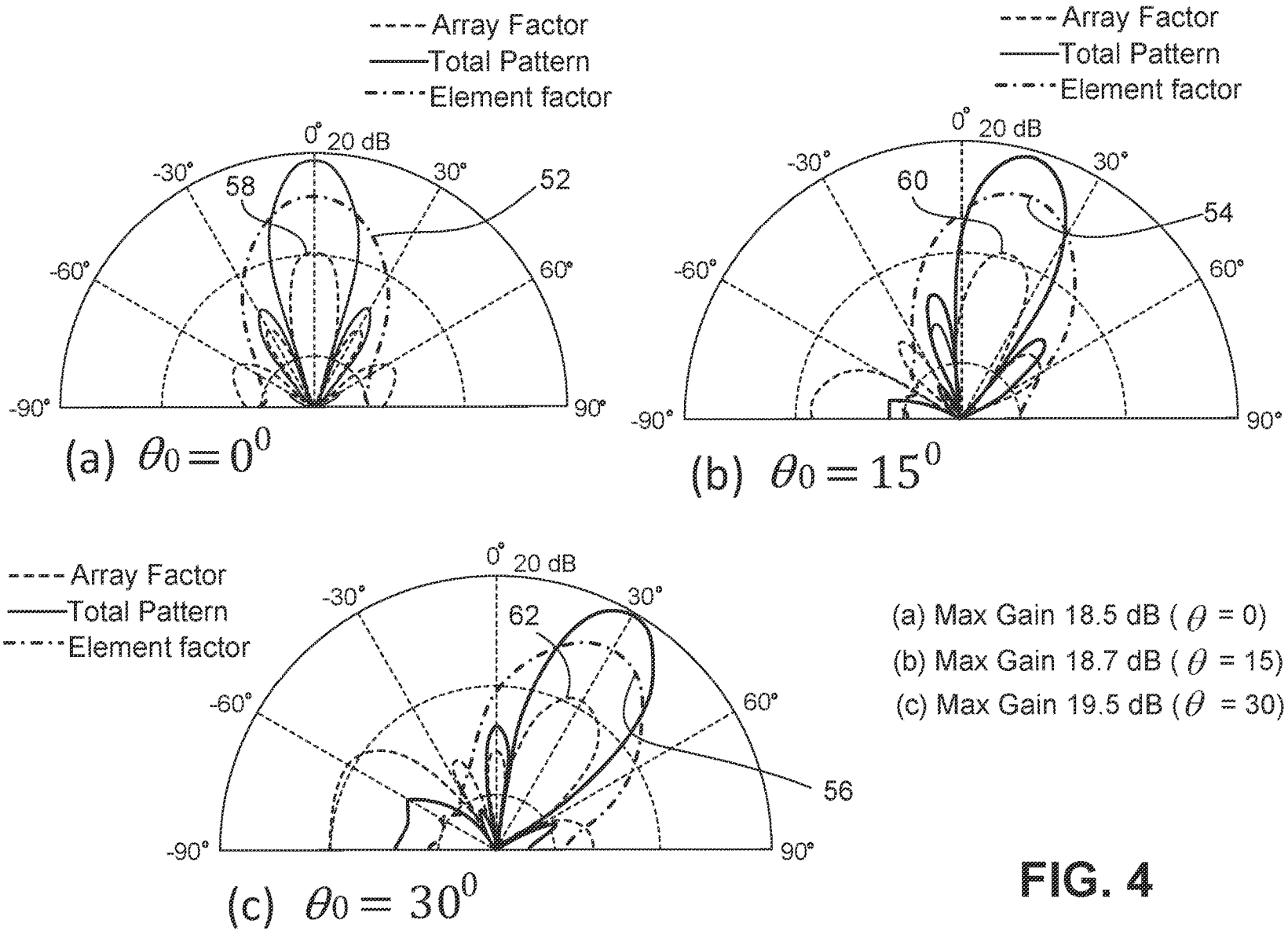

Simulated beam steering for both a legacy PAA with a half-wave length inter-element spacing and an example RSAA using the technology that we describe here are shown in FIGS. 3 and 4. As shown in FIG. 3, as the array factor of a legacy PAA is steered, the side lobe levels increase 40, 42, 44 and the gain 46, 48 decreases because of the fixed character of the individual element factor 50. In contrast, as shown in FIG. 4, for the RSAA that we describe here, steering of the element factor of each of the individual reconfigurable antenna elements 52, 54, 56 synchronously with steering of the array factor 58, 60, 62 results in higher gain and lower side-lobe levels. Notice that the RSSA with PRA described here not only has much higher (~>8-9 dB more) array gain but also has much smaller side lobe levels than those of legacy sparse array. We use the term synchronously in this example to refer both to aligning the directions of the main lobes of the array factor and all of the element factors and to coordinating the matched alignments at the same time. However, as mentioned later, other approaches may also be useful. A 5G mm-wave base station may change the beam direction it is using to transmit or receive very frequently. In some implementations, a base station may change the beam direction after one slot time, or 125 microsecond. In some other implementations, the base station may change the beam as fast as after two symbol intervals, or in less than 18 microsecond.

Figure 5:
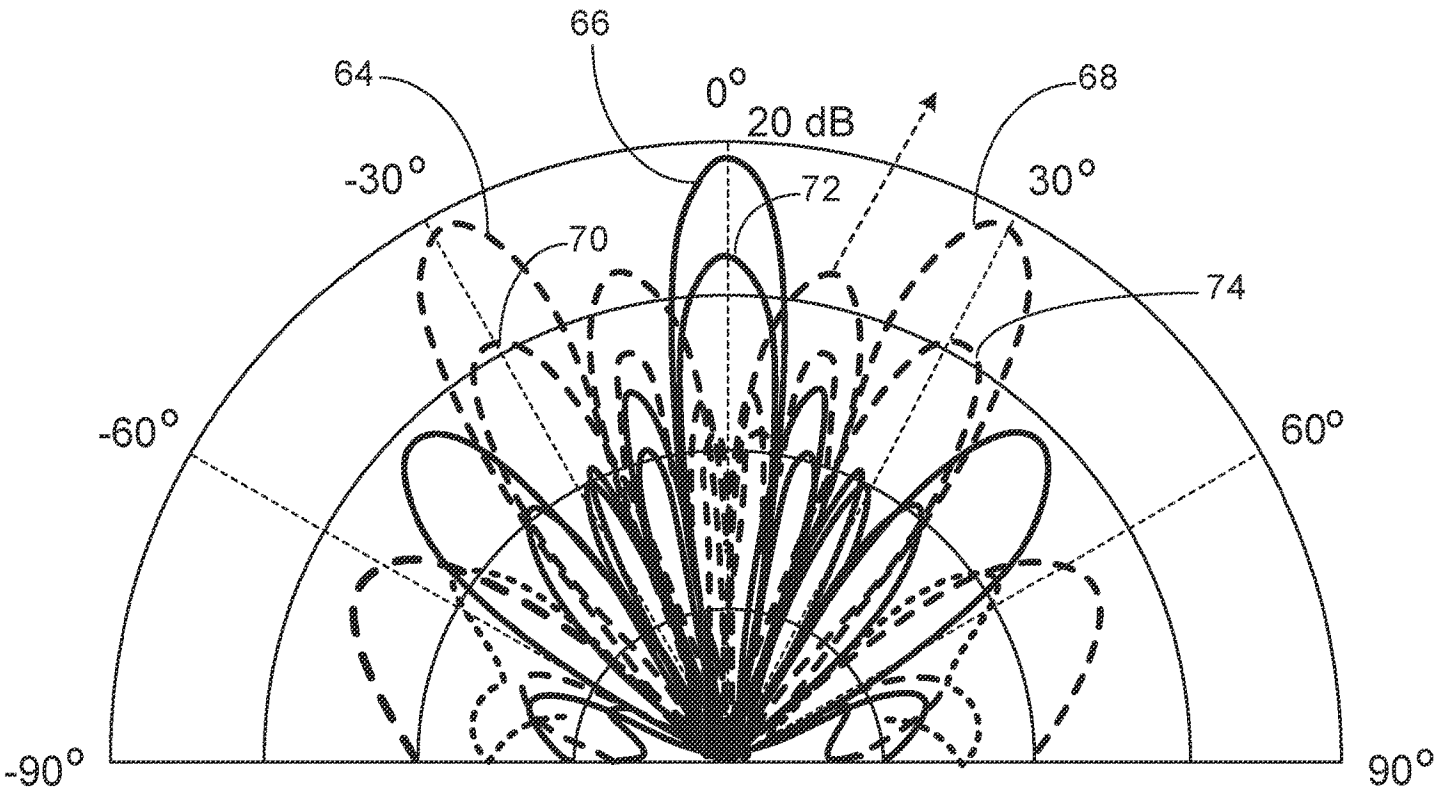

A comparison is shown in FIG. 5 between the element factors and array factors of a legacy sparse array without active amplitude tapering and the RSAA using the technology that we describe here and in which both of the arrays use in inter-element spacing of 1.4 times $\lambda_{air}$. In FIG. 5, the maximum of the main lobe 64, 66, 68 of the beam of the RSAA described here is higher and remains more constant than the maximum of the main lobe 70, 72, 74 of the legacy sparse array.

As shown in FIGS. 6 and 7, in some implementations, a baseband signal processing unit 80 provides BCI 82, beam control information, to a beam control unit 84, which forwards the beam control information to a beam former core chip 86, which uses the control information to set the array coefficients, i.e., phases and amplitudes ($a_{ij}$, $\alpha_{ij}$) 85, to steer the array factor's main beam in a specific direction and adjust the array factor of the RSAA 88. The beam control unit also determines $dc_{ij}$ outputs 90 and provides them to a diode control circuit 92, which uses them to control the switch elements of the individual antenna elements 94 in order to cause them to operate in accordance with selected reconfigurable antenna modes in coordination with the steering of the array factor's beam direction. The $dc_{ij}$ outputs are so chosen that each individual element factor, i.e., the direction of each individual element's pattern, is aligned with that of the array factor's main beam, and the nulls of each individual element's pattern are so placed to reduce the side lobe levels of the array factor's main beam.

In some examples of the technology that we describe here, as shown in FIG. 7 (a system level schematic of circuitry for joint control of the beamformer chip and PIN diode control circuit (driver)), based on the distribution of user devices being served, a base band processing unit 80 determines the beamforming coefficients (weights), i.e., antenna array feeding coefficients. It then sends the coefficients to a field programmable gate array (FPGA) microcontroller 94 which acts as a joint controller for a beamformer core chip 86 and a PIN diode driver 92. The joint controller determines the PRA modes to steer the radiation maximums of the beams of the individual PRAs toward the array factor maximum and to steer the nulls of the beams of the individual PRAs toward the array factor side lobes. For this purpose, the microcontroller 94 executes the function of the beam control unit 84. The array factor is determined from the beamforming coefficients. The beam control unit sends the beamforming coefficients to the core chip via SPI lines 96. At the same instant (synchronously), the beam control unit also sends the pin diode activation signals to the pin diode driver via GPIO lines 98.

In some implementations, the beamforming coefficients can be stored in the core chip memory and activated or latched by the beam control unit by sending proper activation signals to the core chip. In such implementations, the joint controller will send both core chip and pin diode activation signals at the same instant (synchronously).

In some implementations, the beamforming coefficients are then applied to all of the individual PRA antenna elements simultaneously (synchronously) when the pin diode activation signals are sent to the switch elements of the respective PRA elements.

As shown in FIGS. 8 through 10, in some examples of the technology that we describe here, a 4×1 RSSA structure 100 includes four individual PRAs 102, a mechanical support layer 104 having four solid side spacers enclosing an air cavity, and a superstrate 106 of which the bottom surface houses a PRS. Layers identified with the letter "M" represents metallic layers, and layers represented by the word "Core" represents a substrate material. Aperture-coupled patch antennas 108 are used as the driven antennas of the PRAs. The bottom surface of core-1 (indicated as M1 in FIGS. 8 and 10) contains microstrip feed lines 107 which couple the EM (electromagnetic) energy from the core chip 86 to the driven patches 108 placed on the M3 layer (top surface of core 2) via the slits 110 in M2 ground layer. The distance (spacing) 112 between the adjacent PRAs is >one $\lambda_{air}$. Each PRA has 2 metallic strips 114, 116 placed on the top surface of core-3 (indicated as M4 in FIGS. 8 and 10). In some implementations, single-pole single-throw type switch elements 118 (e.g. PIN diodes, MEMS), placed in the metallic strips in M4, can be turned on and off to change the electrical length of the corresponding metallic strip. The radiation pattern of each of the PRAs can be reconfigured (for example, to reconfigure its beam direction in accordance with an intended direction indicated by the baseband processing unit) by changing (shortening or increasing) the electrical lengths of its metallic strips For example, in FIG. 8, strips (1) and (2) are associated with the first PRA element on the left, and strips (7) and (8) are associated with the fourth PRA element on the right.

As shown in FIG. 13, for example, in a typical PRA element 150, a driven patch antenna 152 electromagnetically couples energy to two reconfigurable parasitic metallic strips (strips S1 and S2) placed above (spaced apart from) the patch antenna. The locations of the metallic strips are chosen to obtain good electromagnetic coupling between the driven antenna and the strips. The radiation pattern of the PRA element can be reconfigured by changing the effective electrical lengths of the metallic strips. The effective electrical lengths of the parasitic metallic strips are changed by switching the interconnecting PIN diodes, causing each of the parasitic metallic strips to act either as a reflector or as a director to cause beam steering. Similar to the case of Yagi-Uda antennas, a parasitic metallic strip having a slightly longer length then the resonant patch antenna acts as a reflector while a parasitic metallic strip having a slightly shorter length then the patch antenna acts as a director.

In the PRA element shown in FIG. 13, the length L of the strips is chosen to be larger than the resonant length (which is $\lambda/2$ in the effective medium underneath the strips). As a result, when the PIN diode of the strips is turned ON, the effective electrical length of the strip becomes larger than resonant length and it acts as a reflector steering the beam in the opposite direction (away from the strip). When a PIN diode is OFF, the effective electrical length of the corresponding strip becomes smaller than the resonant length, and it acts as a director steering the beam towards that strip. As an example, when the PIN diode for strip S1 is ON, the pixels (the two sub strips) of strip S1 are connected, the length of strip S1 becomes L, and the strip S1 acts as a reflector.

Figure 14:
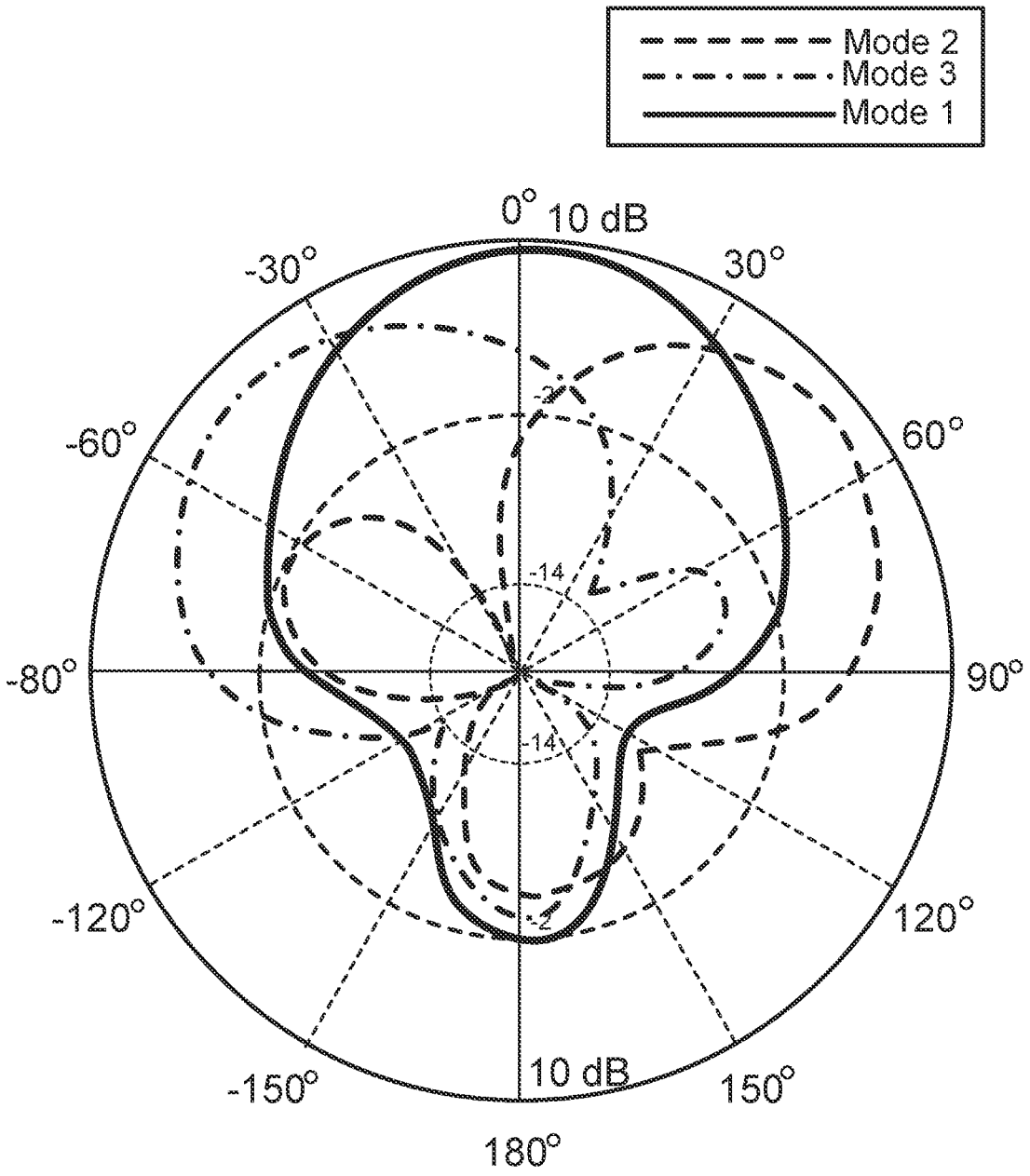

When the PIN diode for strip S2 is OFF, the two pixels of strip S2 are disconnected and, therefore, strip S2 acts as a director. Therefore, keeping the PIN diode for strip S1 in an ON state and the PIN diode for strip S2 in an OFF state, will steer the beam to the right-hand side in the y-z plane (that is, away from strip S1 and toward strip S2). This can be referred to as mode 2. In some implementations, the modes of a PRA element and the corresponding switch states are as shown in the following table, and the corresponding radiation patterns are shown in FIG. 14.

| Mode | Steering Direction (φ, θ) | S1 | S2 |
|---|---|---|---|
| 1 | ($0^o$, $0^o$) | 0 | 0 |
| 2 | ($90^o$, $30^o$) | 1 | 0 |
| 3 | ($90^o$, $-30^o$) | 0 | 1 |

The partially reflective surface (PRS) 120 in FIG. 9, which is shown in FIG. 8 as M5, reduces the side lobe levels of the array factor by creating a passive tapered current distribution. As shown in FIG. 9, the PRS includes rows 122 of features 124. The rows are spaced apart by inter-element distances, and the left and right sides of the PRS, including the inter-element distances, $a_1<a_2< \ldots <a_9$, are symmetric.

The superstrate (indicated as core-5 in FIGS. 8 and 10) is suspended above (e.g., spaced apart from) core-3 using a four-sided spacer 126 closing an air cavity 128. This structure forms a leaky wave/fabry perot-type antenna which enhances the gains of the individual PRA elements and hence the gain of the total array. The spacing 130 between the ground plane and the superstrate is chosen to be close to a half wavelength in the effective medium formed in between. The thickness 132 of the superstrate can be close to a quarter wavelength in the substrate.

For comparison, the schematics for a legacy sparse array are shown in FIGS. 11 and 12.

EXAMPLES

Other implementations are also within the scope of the following claims.

For example, although we have described examples of controlling the individual antenna elements synchronously with the antenna array factor (that is, exactly with respect to the direction and timing of the steering and the polarization and frequency of the beam), useful implementations may entail variations in that approach in which the individual antenna elements are steered in directions that are not exactly matched with the steered direction of the antenna array or are not steered at precisely the same moment as the antenna array or both. In addition, although we have described examples in which all of the individual antenna elements are steered together in the same direction and at the same time, in other instances, it may be useful to steer different ones of the antenna elements in different directions or at different times relative to one another in war relative to the antenna array. Different antenna elements can also be controlled to produce beams of different polarizations (linear, circular, elliptical) and frequencies within the frequency band of interest (e.g., at 28 GHz within the 25-29 GHz band).

Figure 15:
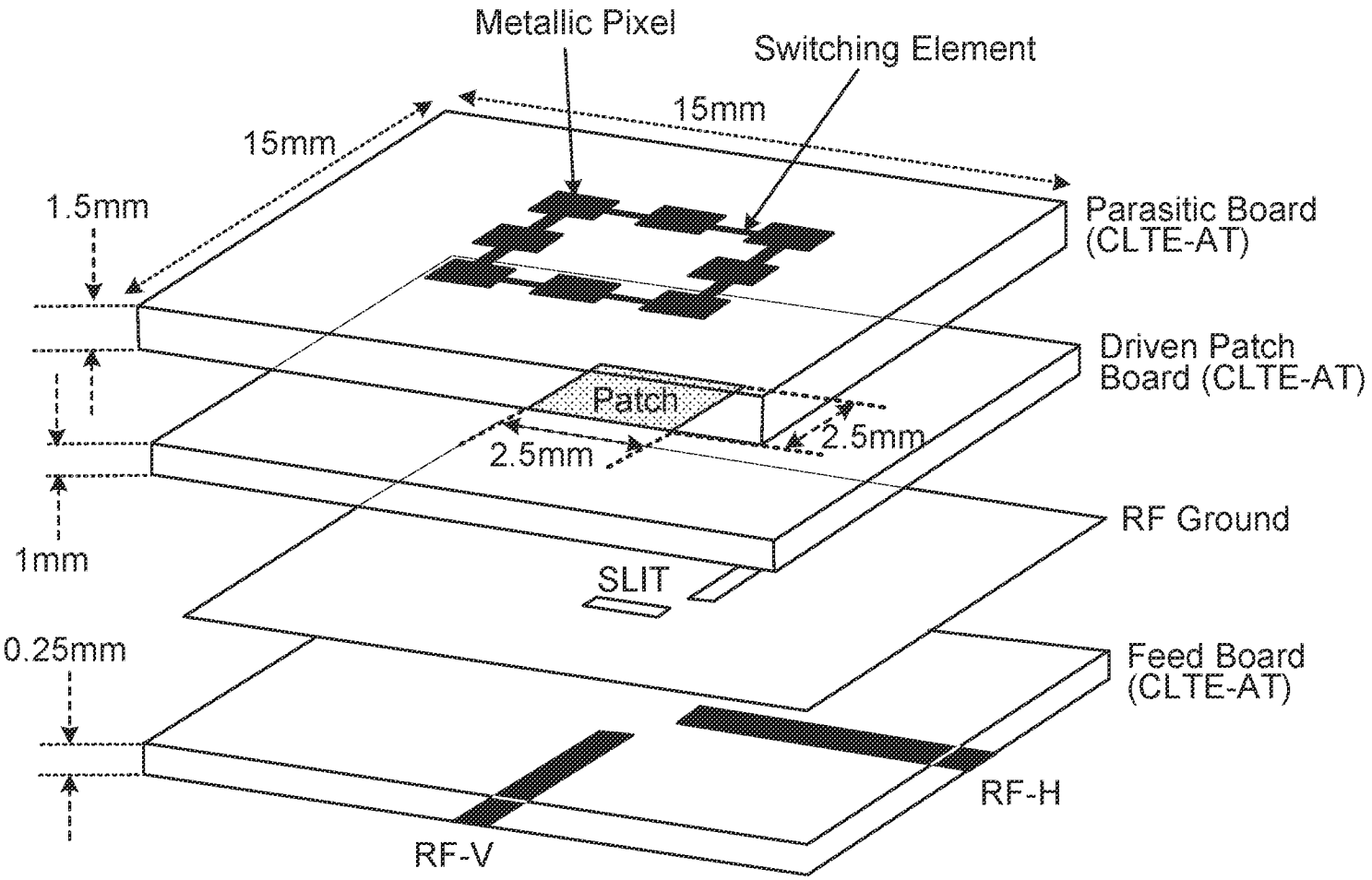

FIGS. 15 through 21 illustrate specific dimensions and configurations of seven different PRA elements. A wide variety of other configurations, shapes, sizes, materials, numbers, and other characteristics of the RAA, the PRAs, the patch antennas, the metallic strips, and other elements of the RAA and the PRAs may also be used. FIGS. 15 through 21 illustrate the following examples:

FIG. 15—Dual polarized PRA with a square ring-shaped reconfigurable parasitic surface.

Figure 16:
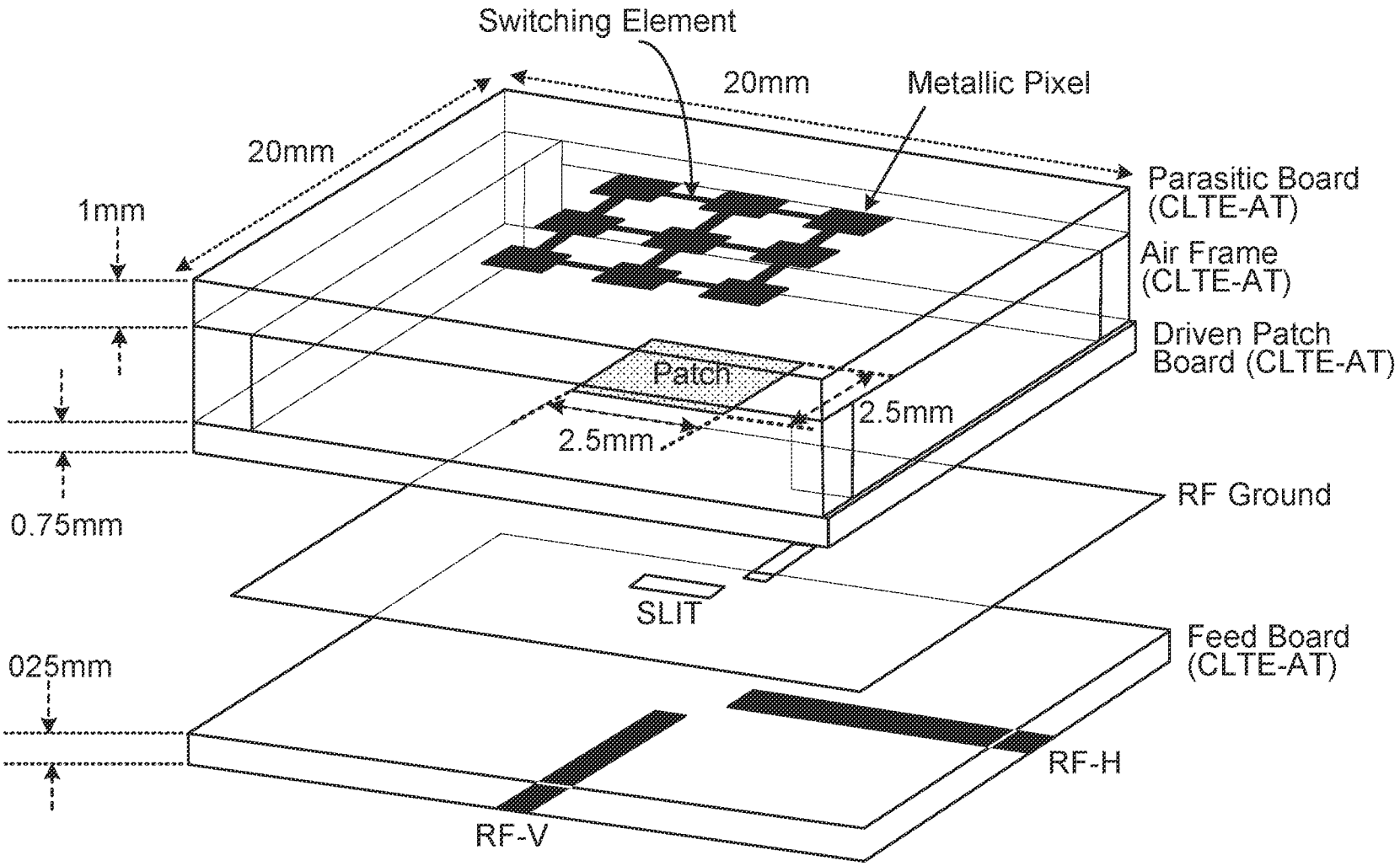

FIG. 16—Dual polarized PRA with a 3×3 grid of metallic pixels in a reconfigurable parasitic surface.

Figure 17:
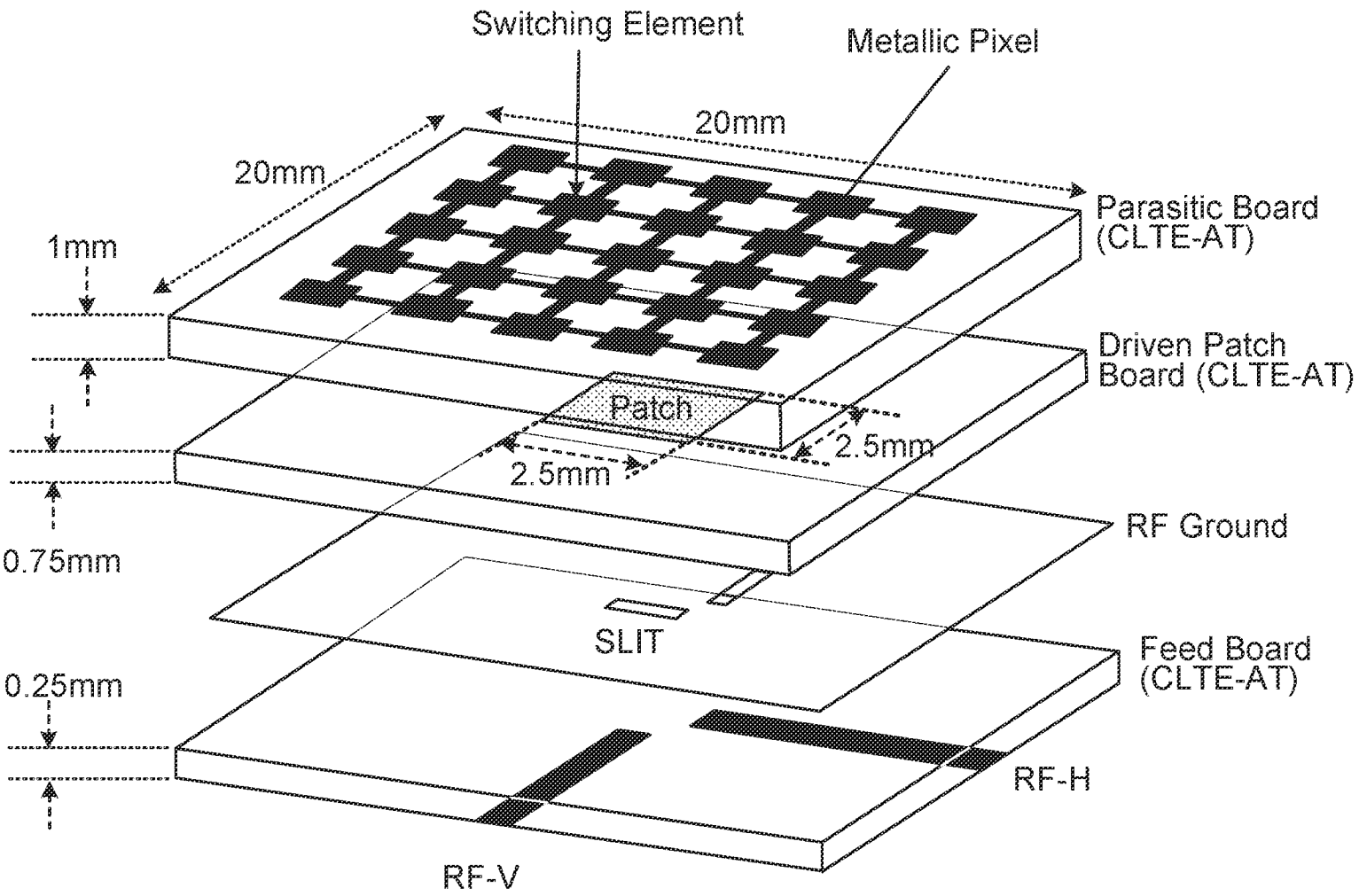

FIG. 17—Dual polarized PRA with a 5×5 grid of metallic pixels in a reconfigurable parasitic surface.

Figure 18:
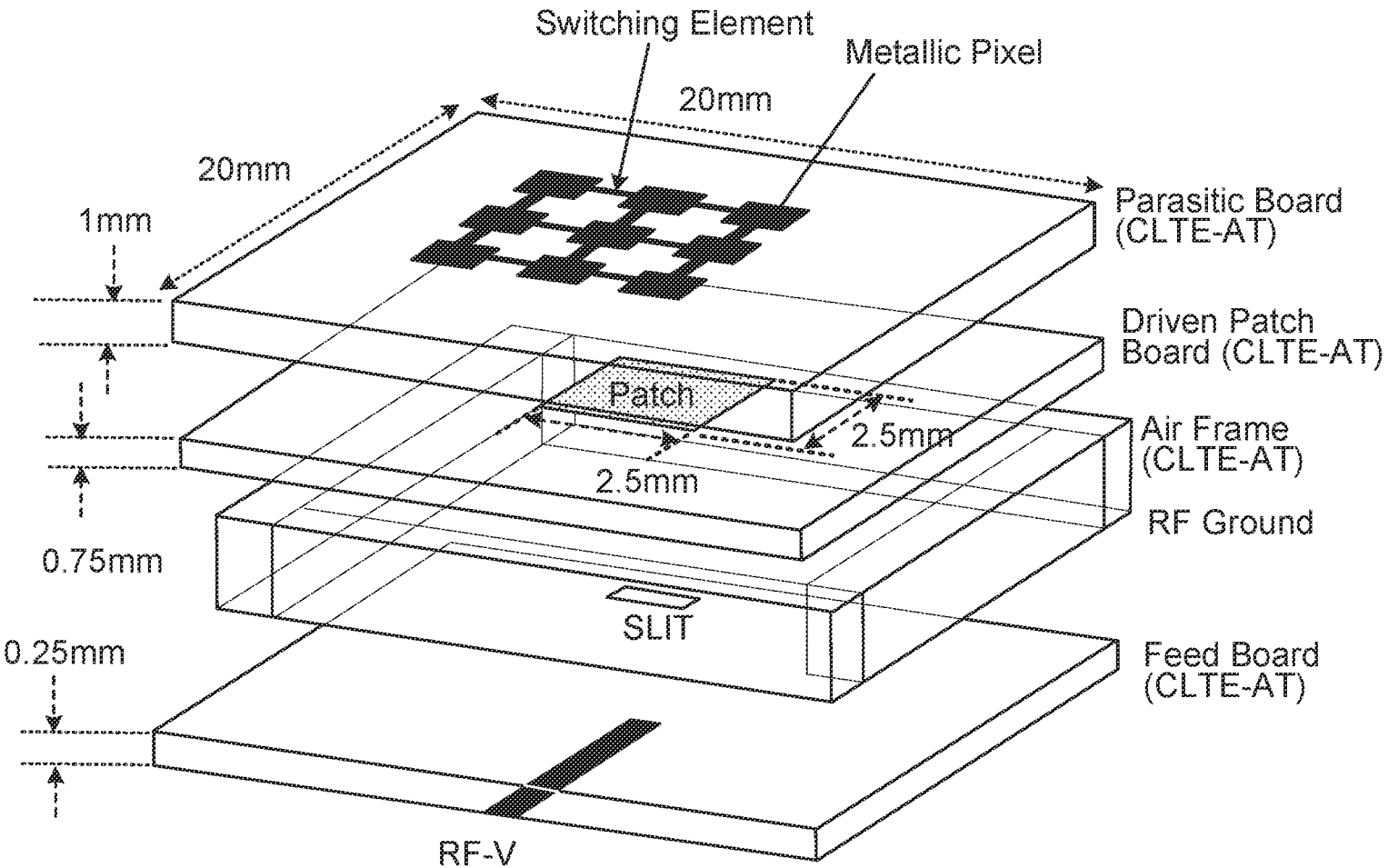

FIG. 18—Single polarized PRA with the 3×3 grid of metallic pixels and a reconfigurable parasitic surface.

Figure 19:
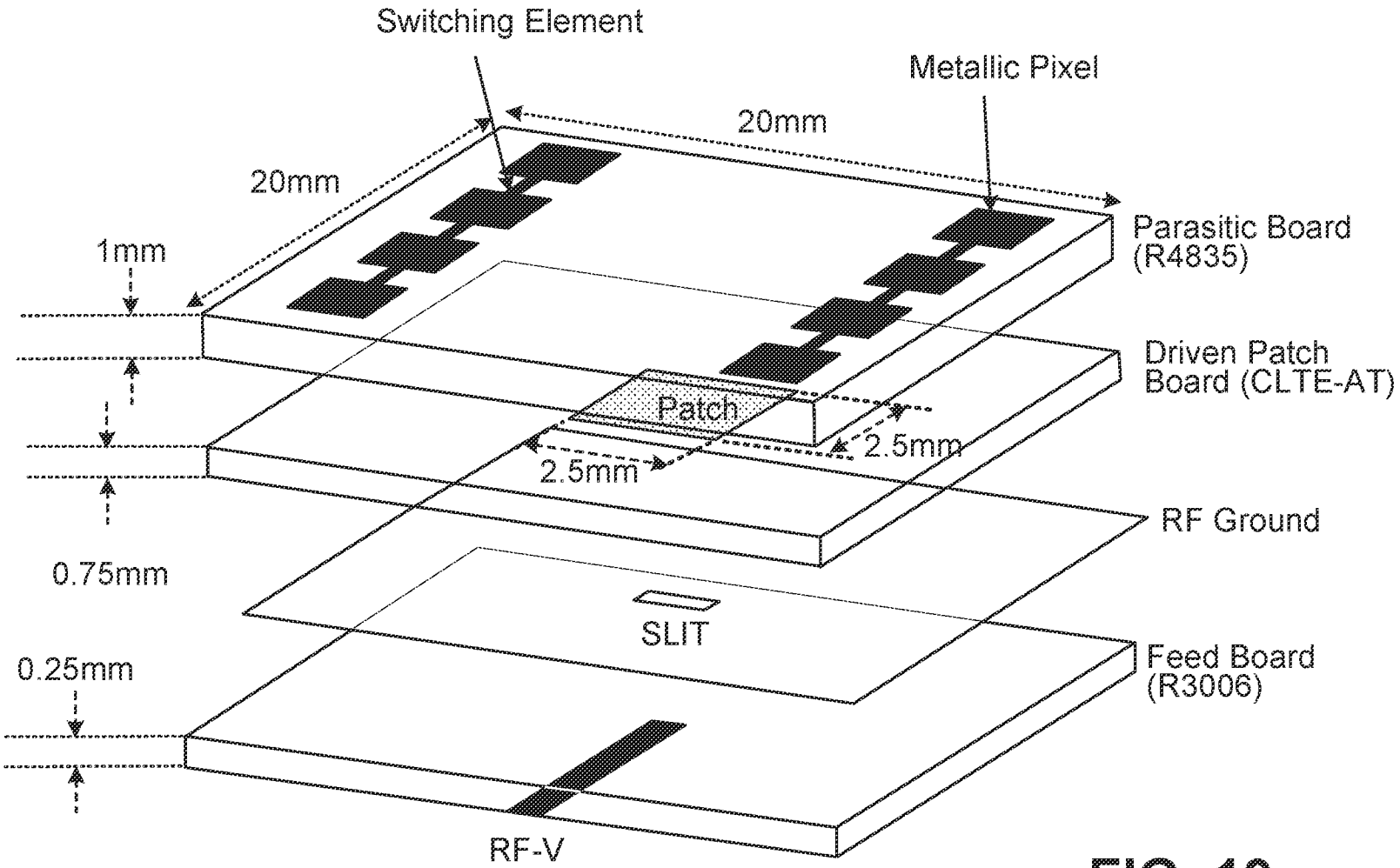

FIG. 19—Single polarized PRA with the 2×1 grid of metallic pixel strips in a reconfigurable parasitic surface.

Figure 20:
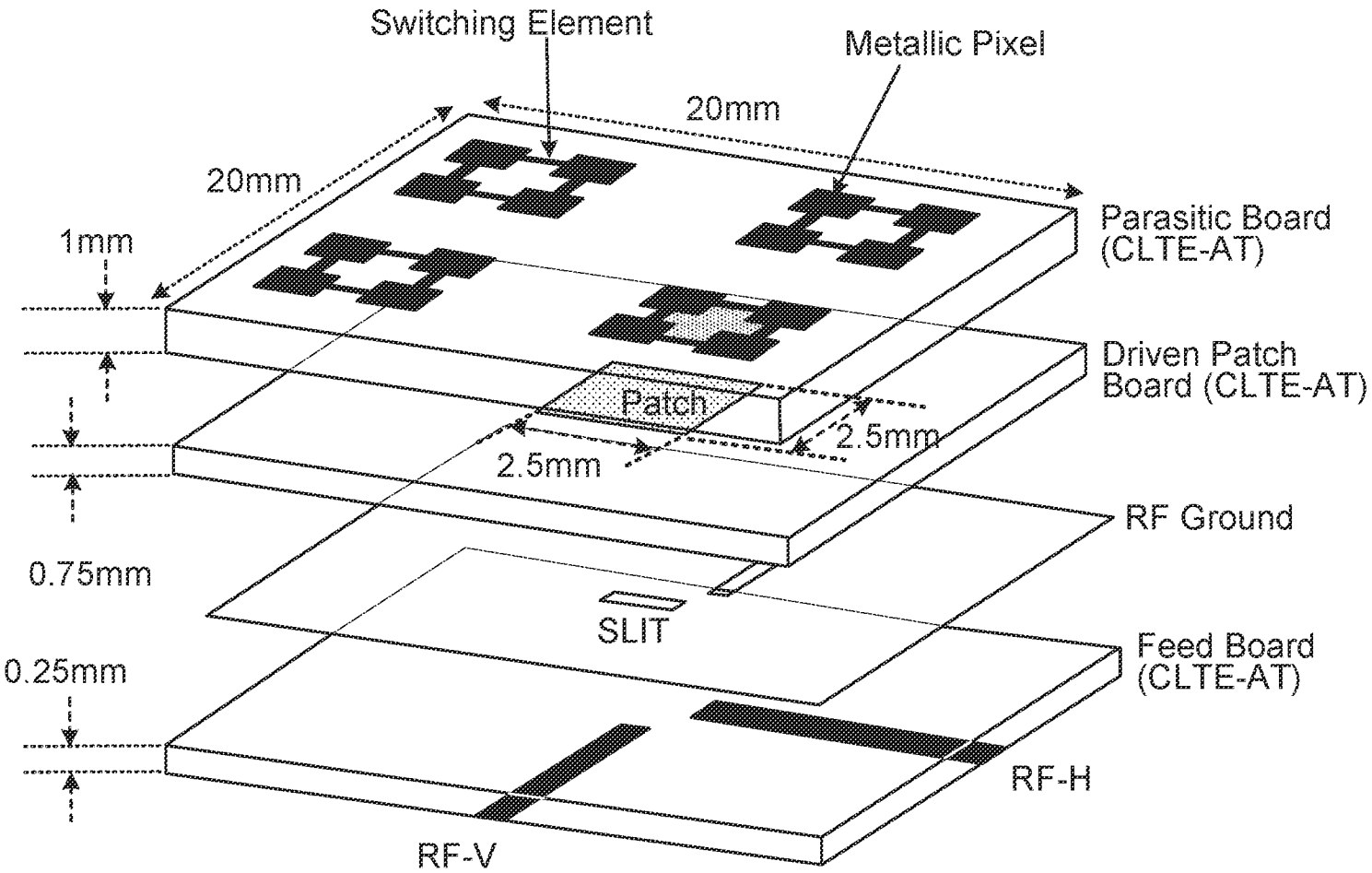

FIG. 20—Dual polarized PRA with the 2×2 grid of pixel clusters in a reconfigurable parasitic surface.

Figure 21:
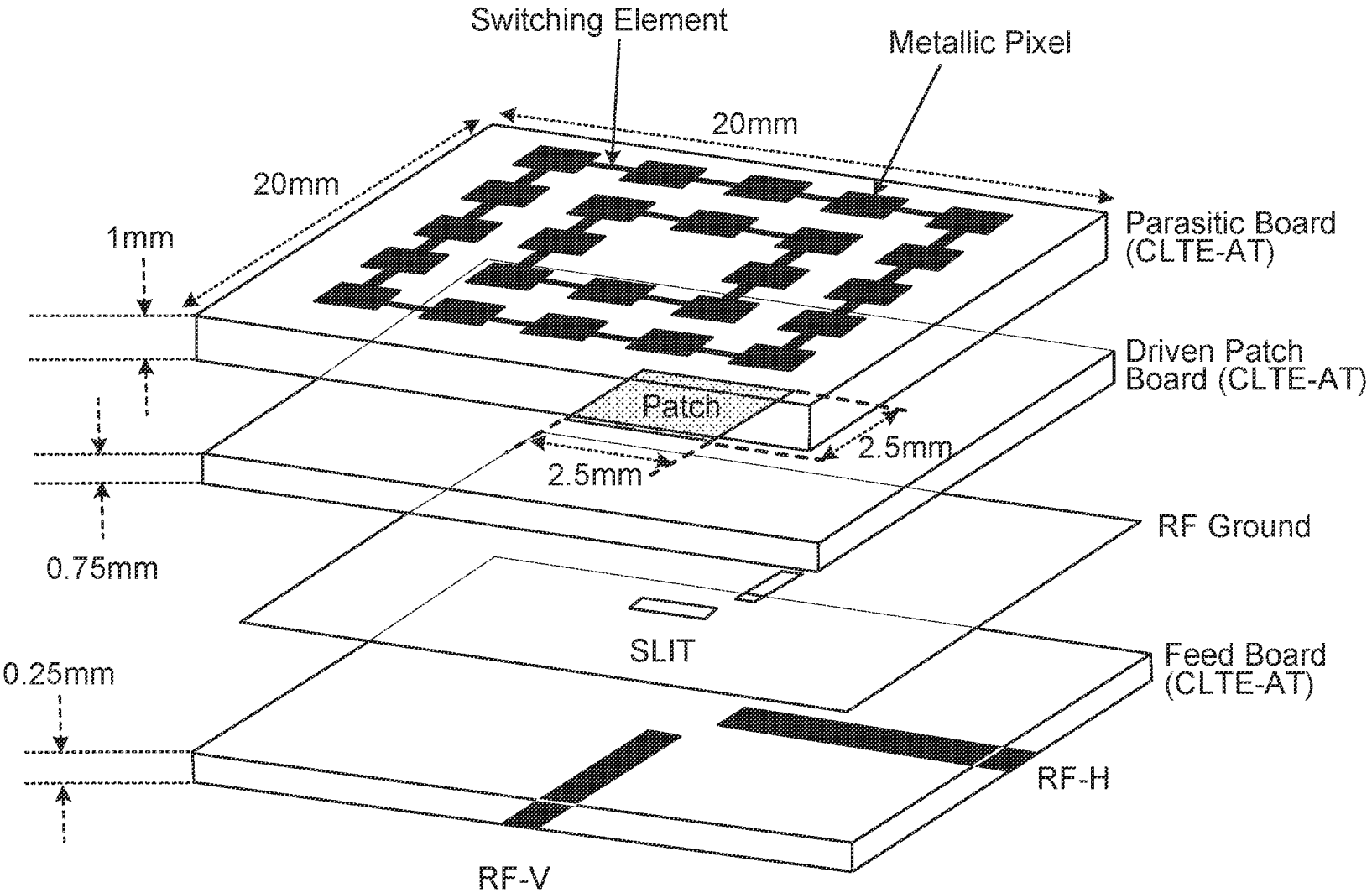

FIG. 21—Dual polarized PRA with two concentric square pixel rings in a reconfigurable parasitic surface.

The invention claimed is:

1. An apparatus comprising a reconfigurable antenna array (RAA) comprising individual pattern reconfigurable antennas (PRA), each of the PRAs having (a) an antenna, (b) controllable components that are controllable to generate and effect any of two or more modes of the PRA, the two or more modes corresponding to respective different steered radiation patterns, and (c) inputs to receive drive signals for the antenna and control signals for the controllable components, wherein the drive signals for each PRA include electromagnetic energy to be radiated using the PRA; and control circuitry having outputs coupled to the inputs of the PRAs, the control circuitry configured (i) to drive the antennas of the PRAs to form an array beam having an array peak in a particular direction, and (ii) to deliver the control signals for the controllable components to effect, for each of the PRAs, a selected mode corresponding to a steered radiation pattern that has a peak in the particular direction of the array beam and has one or more nulls in directions of one or more side-lobes of the array beam.

2. The apparatus of claim 1 in which the different steered radiation patterns comprise different polarizations.

3. The apparatus of claim 1 in which the different steered radiation patterns comprise different frequencies.

4. The apparatus of claim 1 in which the RAA comprises a reconfigurable sparse antenna array (RSAA).

5. The apparatus of claim 1 in which the controllable components comprise switching devices.

6. The apparatus of claim 5 in which the switching devices comprise PIN diodes.

7. The apparatus of claim 1 in which the controllable components comprise varactors.

8. The apparatus of claim 1 in which the individual pattern reconfigurable antennas are sparsely spaced.

9. The apparatus of claim 1 in which the controllable components comprise a reconfigurable parasitic layer.

10. The apparatus of claim 1 in which the control circuitry comprises a beam former circuit.

11. The apparatus of claim 1 in which the control circuitry comprises a processor executing an algorithm.

12. A method comprising:

driving, with drive signals, pattern reconfigurable antennas (PRAs) that are part of a reconfigurable antenna array (RAA) to form an array beam having an array peak in a particular direction, wherein the drive signals for each PRA include electromagnetic energy to be radiated using the PRA; and controlling controllable components of each of the PRAs to effect a selected mode of the PRA for which a steered radiation pattern from the PRA has a peak in the particular direction of the array beam and has one or more nulls in directions of one or more side-lobes of the array beam.

13. The method of claim 12 in which the selected mode is one of two or more modes of each PRA, the two or more modes corresponding to respective different steered radiation patterns, wherein the different steered radiation patterns comprise different polarizations.

14. The method of claim 12 in which the selected mode is one of two or more modes of each PRA, the two or more modes corresponding to respective different steered radiation patterns, wherein the different steered radiation patterns comprise different frequencies.

15. The method of claim 12 in which the RAA comprises a reconfigurable sparse antenna array (RSAA).

16. The method of claim 12 in which controlling the controllable components comprises switching states of the controllable components.

17. The method of claim 16 in which the controllable components comprise PIN diodes.

18. The method of claim 12 in which the controllable components comprise varactors.

* * * * *